United States Patent [19]

Jones

[11] Patent Number: 4,490,840

[45] Date of Patent: Dec. 25, 1984

[54] ORAL SOUND ANALYSIS METHOD AND APPARATUS FOR DETERMINING VOICE, SPEECH AND PERCEPTUAL STYLES

[76] Inventor: Joseph M. Jones, 157 Monahan Dr., Fort Walton Beach, Fla. 32549

[21] Appl. No.: 363,566

[22] Filed: Mar. 30, 1982

[51] Int. Cl.[3] ..... G10L 1/00

[52] U.S. Cl. ..... 381/48; 364/513.5

[58] Field of Search ..... 381/41, 48; 128/715

[56] References Cited

U.S. PATENT DOCUMENTS

| | | | |
|---|---|---|---|
| 3,760,108 | 9/1973 | Gacek et al. | 381/49 |
| 3,971,034 | 7/1976 | Bell et al. | 381/48 |
| 4,063,035 | 12/1977 | Appelman et al. | 381/48 |
| 4,142,067 | 2/1979 | Williamson | 381/41 |
| 4,335,276 | 6/1982 | Bull et al. | 381/48 |

*Primary Examiner*—E. S. Matt Kemeny

[57] ABSTRACT

Vocal sounds of organisms, particularly humans, may be analyzed for characteristics defined as voice-style (resonance, quality), speech-style (variable-monotone, choppy-smooth, etc.), and perceptual-style (sensory-internal, hate-love, etc.). The amount of each characteristic is calculated from relative and difference values of measured elements including six spectral peaks and pauses. Coefficient tables indicate the relative contribution of measured elements.

24 Claims, 2 Drawing Figures

ORAL SOUND ANALYSIS METHOD AND APPARATUS FOR DETERMINING VOICE, SPEECH AND PERCEPTUAL STYLES

BACKGROUND OF THE INVENTION

1. Field of the Invention

This invention relates to a method and apparatus that segments vocal sounds, such as human voice and speech utterances, and reassembles digital representations of the segments into a specified set of style elements, which, with specified instructions, derives style dimension values of voice, speech, and behaviorally related perceptual processes for measurement and research of a subject's vocal/perceptual profile.

2. Description of the Prior Art

The underlying concepts of the present invention can be best understood by first realizing that an excited voice, for instance, naturally sounds different from a dull voice, and that, while working, a newscaster talks differently from a softball coach, coaching, or a poet reading poetry, or a mother talking expressively or angrily to her baby. That there are literally hundreds of rather universal forms or styles of voice and speech used for human communication for rather universal tasks or situations, is natural.

A second concept that is necesary for one to understand the technical aspects of this invention is that there is something naturally different in our "frame-of-mind" or perceptual processes when we are involved in different tasks such as instructing children in algebra, as compared to, when we are demanding to be heard at a town meeting, trying to sell something, or trying to talk a reluctant mate into making love.

This invention considers building blocks of "frame-of-mind" to be "perceptual dimensions" and then allows the user to compare both trial and built-in or machine standard perceptual dimensions with either built-in machine standard or trial voice or speech style elements, so that the user might then obtain an individual's profile or discover new relationships. This invention, thereby will allow psychologists, and speech and cognition researchers, to measure machine standard style elements and dimensions or assist in the standardardization of new ones. The user can measure a vocal sound and compare it to those of people or animals in similar invironments or doing similar tasks. The user can thereby determine probabilities tht the perceptual profile of the speaker or even animal is similar to that of specified groups having a similar vocal profile.

A book by the inventor, a professional engineering psychologist, attempts to lay the foundation for understanding the sub-division of cognitive or preceptual processes of awareness into a specified set of dimensions that are sensitive to a similarly specified set of vocal elements.

A description of the differences in the disclosed invention and the prior art requires first an overview of the functional categories of theory and devices. Vocal measurement apparatus has consistently described psychological relationships to voice and/or speech primarily in terms of a specific single variable rather than the multiple dimensions necessary to constitute a vocal/-perceptual profile of the subject. The variables referred to in other patents are generally too vague to be meaningful to psychologists.

"Stress", "emotion" and "normal", in relation to either vibratto, pitch, nasality or one or two voice formants, can only be useful to determine a single event, such as lying or helping a subject to alter his volume or pitch or nasality for better speech effect, or to indicate "stress" or "emotion".

The fact that all people are always under some degree of numerous stresses and always expressing a very complex array of a combination of many emotions and also other cognitive, perceptual, or awareness processes not related directly to "emotion" is generally ignored. The usual orientation is as if there is a single "degree" of stress, and a single kind of "emotion" which, as if by toggle-switch, is either on or off.

Psychologists give batteries of pencil and paper tests, inkblot tests, block placement tests, logic tests, I.Q. tests, etc. (hundreds have been developed) in an attempt to arrive at a composite profile of a subject that can be described in terms of numerical values along a meaningful set of several major psychological dimensions. At least three such dimensions are usually necessary to derive a single profile. A half dozen dimensions is a frequent approximate number utilized to derive a single profile. That a useful awareness or perceptual profile can be derived from a vocal sample, unobtrusively, has not only been unavailable, but is not being suggested nor contemplated in any related scientific literature or prior patent art, except in the present disclosure and the inventor's scientific papers, reports, and book on the subject.

Before broad relationships between voice and mental processes could occur, an appropriate perceptual processing profile description with theory had to be evolved relating to a specific set of vocal dimensions. Psychological processes significant to a profile must include normal, not just abnormal processes, and also include those relating to logic utility by an individual and their occupation, sensory and abstract awareness, and self-to-system parameters. None of these necessarily accent either stress or emotion, but rather social hierarchy, altruism, beliefs and loyalties, planning and general social interaction dynamics.

The awareness attributes of these dynamics must be reducible to specific perceptual or cognitive processing dimensions, such as value sensitivities, self-other ratio, sensory-internal ratio, attachment variables such as love-repulsion or independence-dependence, and career or task affinities such as perceptual emphasis on feelings versus logic, or either versus physical attributes. Such a collection of several nearly orthogonal dimensions can constitute a meaningful perceptual profile of an individual.

The idea that the human voice conveys these complex relationships as dimensions of awareness or perceptual processes is unconventional, not theorized scientifically, not generally contemplated, and not now available through the prior art nor described in any index of scientific literature.

The set of vocal dimensions that relate to perceptual processes of awareness sufficient in number and selection to constitute a profile can simultaneously provide speech therapists with a vocal profile. This is because the speech dimensions of interest to speech therapists tend to be those which are frequently abused by patients and tend to relate to psychological problems. The inventor's book, cited below, details both the vocal and awareness or perceptual process interrelationships made possible for the first time by his own key discoveries (see presentation to scientific society below) and his theory (thirty years in development). The seven vocal profile dimensions include two voice and five speech dimensions, namely: resonance, quality, variability-monotone, choppy-smooth, stacatto-sustain, attack-soft, and affectivity-control.

These vocal dimensions which relate to perceptual dimensions are not directly accessible by machine the way pitch, nasality, formants, vibratto or volume are. The voice, speech and perceptual dimensions of the present disclosure require assembly from fourteen specific fundamental properties representative of the voice signal in the frequency domain, plus four arithmatic relationships among these, plus the average differences between several hundred consecutive such "time slices" in the time domain. Only by such a complex assembly, (using a cooperative arithmatic and logic algorithm) of a specific set of machine disassembled vocal signal properties can normal speech be unobtrusively related to speech, voice and perceptual dimensions. The analysis of continuous, normal speech, rather than an obtrusive, elicited, specified vocal sound or a specific phrase, unlike much preceding art, requires great flexibility and complexity in order to ascertain pertinent style dimensions.

All related prior art attempts to measure specified voice or speech features directly, such as pitch, loudness, formant positions, etc. in order to demonstrate stress, preferred speech, or vocal qualities, etc. The present invention segments the vocal utterances into six peaks in the frequency domain, none of which is pitch, and not all in recognized ranges of specific formants, and develops specific ratios for these. No prior art does this. While stress, emotion, pitch and formants are specifically of interest to prior art in this area, none are of specific interest to the present disclosed invention.

Speech style dimensions are assembled from disassembled vocal elements to produce two voice and five speech dimensions, namely: "resonance" and "quality", "variability-monotone", "choppy-smooth", "stacatto-sustain", "attack-soft", "affectivity-control".

In U.S. Pat. No. 4,335,276 to Bull, et al. nasalization has the same four major sections as does the present invention: (1) analog pre-processing using filters, (2) analog to digital conversion, (3) a microcomputer with controlling logic, (4) display with control logic and key-pad or keyboard for operator control.

However, Bull uses two inputs to two filters. One of the inputs is from an accelerometer mounted on the external nasal wall of the subject. The present disclosure is not concerned with nasal resonance and thus does not use a second input mounted on the speaker.

There are many kinds and degrees of resonance. The disclosed invention measures two voice quality parameters, one of which is labeled resonance, but it is not nasal resonance, has nothing to do with "nasality", and is not measured using any of the Bull apparatus, method or vocal aspects. The present disclosed invention does not attempt to measure or analyze nasal resonance disorders, but the resonant properties, of the voice, associated with natural, social hierarchy elements of a normal subject's perceptual profile, unobtrusively.

The present invention, unlike prior art and certainly unlike Bull's, is an unobstrusive measurement tool, a method for measuring perceptual or awareness processing without disturbing the subject, which otherwise would distort the results unless one is dealing strictly with some physical attribute. Even recorded speech samples can be used with the disclosed invention and the presence of the participant is not necessary.

The present disclosure uses $\frac{1}{3}$ octave filters covering the full audio range, unlike Bull's. The present disclosure provides twenty elements of the speech signal, multiple times per second, rather than one or two features, plus a composite psychological profile not even vaguely attempted by any other prior art.

In U.S. Pat. No. 4,063,035 to Appellman, et al. the first two formants are converted to a single display point on a screen. While this, like Bull's invention is useful and novel, it bears no relation to the present disclosure. While Appellman uses banks of $\frac{1}{3}$ octave filters, as does the present disclosure, so has laboratory equipment for voice analysis dating back many years, Bull uses only peaks from two regions, where prior literature has established that the first two formants are supposed to reside. My research shows that peaks not normally thought of as formants, carry significant information. Appellman states "... there is a false frequency peak in the second formant region that may be of greater amplitude than the described formant". He uses considerable effort to pick the "right" two peaks.

By comparison, the present disclosure uses six peaks including the "false" peak, plus specific ratios, for a total of twenty different building block elements. All of the elements are accessible for manipulations by the operator unlike prior art and also the machine can be switched to automatic so that the algorithms can be operated on by built-in logic to ultimately produce two voice quality and five speech dimensions. These then are utilized by algorithms to produce seven perceptual dimensions making up the final vocal/perceptual profile of the subject. In the present disclosure, all these values are displayed, rather than a single dot indicating the first two formants. Appellman also displays the full spectrum as a bar graph on an oscilloscope. This type of display has been in practice for years, as seen in frequency spectrum analyzers and sound balancing equipment operated by the sound controllers for bands and in recording studios.

The on-board controlling firmware for most if not all commercial $\frac{1}{3}$ octave filter banks for use with small computers, including the one used in the present disclosure, displays these bar graphs upon user request. However, this is incidental and not described herein.

Several additional patents relate to speech. One is an apparatus used in teaching speech to the vocally handicapped, including the deaf, by providing information as to when loudness or frequency range limits are exceeded or are on target (U.S. Pat. No. 3,760,108). However, this prior art specifically limits the sound spectrum of interest to the fundamental frequency and cannot perform the function of assembling vocal utterance elements into voice, speech and perceptual style dimension values for measurement, comparisons, and reseach. Another patent teaches the measurement of pitch perturbations to determine an individual's emotional state (U.S. Pat. No. 4,142,067). However, this prior art specifically does not concern itself with most of the speech spectrum, measuring instead only the first formant region. The presence or absence of emotion is then determined. However, emotion of some degree is always present in people, including stress, and variations in pitch can indicate expressiveness not associated with stress. Also this prior art does not address speech or cognitive style components.

Another patent teaches the measurement of the presence or absence of a low frequency vocal component as it relates to physiological stress (U.S. Pat. No. 3,971,034). However, this prior art is not concerned with most of the speech spectrum, and must be calibrated to each individual, meaning that the stress level obtained cannot be compared to a population mean or standard and does not involve normal perceptual style dimensions. Each of these measures one or two specific vocal parameters and then indicates the presence or absence of these. The assumption is made that stress, lying, or proper speaking is, or is not being exhibited by the user. These inventions do not measure the entire amplitude frequency distribution, determine speech or vocal style elements and dimensions or relate these to perceptual style dimensions through both a built-in and a user supplied coefficient array.

Another speech analyzer reads lip and face movements, air velocities and acoustical sounds which are compared and digitally stored and processed (U.S. Pat. No. 3,383,466). A disadvantage is that the sound characteristics are not disassembled and reassembled into speech style elements or dimensions nor related to perceptual style dimensions. There is a great deal of art relating to speech recognition devices wherein a voice's digital representation is compared to a battery of previously stored ones. Some of these use filters, others use analytic techniques, but none relate normal and typical voice and speech styles to normal and typical perceptual or cognitive style dimensions.

Another technique for analyzing voice involves determining the emotional state of the subject as disclosed in Fuller, U.S. Pat. Nos. 3,855,416; 3,855,417; and 3,855,418. These analyze the amplitude of the speech, voice vibrato, and relationships between harmonic overtones of higher frequencies. However, these inventions are not concerned with natural and typical voice and speech style elements and dimensions and typical perceptual style dimensions, and are limited to stress measurement and the presence or absence of specific emotional states.

The presence of specific emotional content such as fear, stress, or anxiety, or the probability of lying on specific words, is not of interest to the invention disclosed herein. The invention disclosed herein also is not calibrated to a specific individual, such as is typical of the prior art, but rather measures all speakers against one standard because of the inventor's scientific discovery that there exist universal standards of style.

The user can evaluate the similarlity of the various vocal style dimensions of his or her voice (in biofeedback mode) or his client's voice (in therapy setting) to those of target groups such as recording and entertainment stars, successful and unsuccessful people, psychologically dysfunctional people (or a variety of different dysfunctions), self-actualizing people, etc. Any and all naturally occurring groupings of people, occupationally or cognitively, can be assumed to have one or more specific and predictable vocal style components with ranges characteristic of that specific category of people, according to the following citations.

Jones, J. M., 98th Meeting: Acoustical Society of America, Fall 1979; Jones, J. M., Differences in the Amplitude-Frequency Distribution of Vocal Energy Among Ph.D. managers, Engineers, and Enlisted Military Personnel, Masters Thesis UWF 1979; Voice Style, Perceptual Style and Process Psychology, book in Press 1982; and, Jones, J., Vocal Differences Between Members of Two Occupations: An Example of Potential Vocal/Mental Relationships That May Affect Voice Measurement of Pilot Mental Workload, AD-TR-80-57, July 1980.

SUMMARY OF THE INVENTION

A profile of an individual's speech, voice or perceptual profile derived unobtrusively from any speech or language, or even animal sounds, must involve a time and frequency domain dissasembly into fundamental vocal properties, and reassembly capability into building block elements and finally to dimensions of mental (or in the case of animals-behavioral) processes related to perception or awareness.

This has not even been previously specifically theorized, much less attempted in an invented machine. This invention discloses such a machine. Its application is so broad as to include not only speech therapists and psychologists as potential users, but career counselors, artificial intelligence research, cross-cultural comparative cognitions, even population stabilization properties.

The fields needing such a machine are as disparate as all the humanities, as well as industiral psychology, environmental engineering, and mental workload. In short, it should revolutionize both psychological theory and practice as well as the speech sciences and on to speech synthesizer style standardization.

The present disclosed invention accepts vocal sound through a transducer such as a microphone or sound recorder. The physical sound wave, having been transduced into electrical signals are applied in parallel to a typical, commercially available bank of electronic filters covering the audio frequency range. Setting the center frequency of the lowest filter to any value that passes the electrical energy representation of the vocal signal amplitude that includes the lowest vocal frequency signal establishes the center values of all subsequent filters up to the last one passing the energy-generally between 8k hz to 16k hz or between 10k hz and 20k Hz, and also determine the exact number of such filters. The specific value of the first filter's center frequency is not significant, so long as the lowest tones of the human voice is captured, approximately 70 Hz. Essentially any commercially available bank is applicable if it can be interfaced to any commercially available digitizer and then microcomputer. The specification section describes a specific set of center frequencies and microprocessor in the preferred embodiment. The filter quality is also not particularly significant because a refinement algorithm disclosed in the specification brings any average quality set of filters into acceptable frequency and implitude values. The ratio $\frac{1}{3}$, of course, defines the band width of all the filters once the center frequencies are calculated.

Following this segmentation process with filters, the filter output voltages are digitized by a commercially available set of digitizers or preferably multiplexer and digitizer, on in the case of the disclosed preferred embodiment, a digitizer built into the same identified commercially available filter bank, to eliminate interfacing logic and hardware. Again quality of digitizer in terms of speed of conversion or discrimination is not significant because average presently available commercial units exceed the requirements needed here, due to a correcting algorithm (see specifications) and the low sample rate necessary.

Any complex sound that is carrying constantly changing information can be approximated with a reduction of bits of information by capturing the frequency and amplitude of peaks of the signal. This, of course, is old knowledge, as is performing such an operation on speech signals. However, in speech research, several specific regions where such peaks often occur have been labeled "formant" regions. However, these region approximations do not always coincide with each speaker's peaks under all circumstances. Speech researchers and the prior inventive art, tend to go to great effort to measure and name "legitimate" peaks as those that fall within the typical formant frequency regions, as if their definition did not involve estimates, but rather absoluteness. This has caused numerous research and formant measuring devices to artificially exclude pertinent peaks needed to adequately represent a complex, highly variable sound wave in real time. Since the present disclosure is designed to be suitable for animal vocal sounds as well as all human languages, artificial restrictions such as formants, are not of interest and the sound wave is treated as a complex, varying sound wave which can analyze any such sound.

In order to normalize and simplify peak identification, regardless of variation in filter band width, quality and digitizer descrimination, the actual values stored for amplitude and frequency are "representative values". This is so that the broadness of upper frequency filters is numerically similar to lower frequency filter band width. Each filter is simply given consecutive values from 1 to 25, and a soft to loud sound is scaled from 1 to 40, for ease of CRT screen display. A correction on the frequency representation values is accomplished by adjusting the number of the filter to a higher decimal value toward the next integer value, if the filter output to the right of the peak filter has a greater amplitude than the filter output on the left of the peak filter. The details of a preferred embodiment of this algorithm is described in the specifications of this disclosure. This correction process must occur prior to the compression process, while all filter amplitude values are available.

Rather than slowing down the sampling rate, the preferred embodiment stores all filter amplitude values for 10 to 15 samples per second for an approximate 10 to 15 second speech sample before this correction and compression process. If computer memory space is more critical than sweep speed, the corrections and compression should occur between each sweep eliminating the need for a large data storage memory. Since most common commercially available, averaged price mini-computers have sufficient memory, the preferred and herein disclosed embodiment saves all data and afterwards processes the data.

Most vocal animal signals of interest including human contain one largest amplitude peak not likely on either end of the frequency domain. This peak can be determined by any simple and common numerical sorting algorithm as is done in this invention. The amplitude and frequency repesentative values are then placed in the number three of six memory location sets for holding the amplitudes and frequencies of six peaks.

The highest frequency peak above 8k Hz is placed in memory location number six and labeled high frequency peak. The lowest peak is placed in the first set of memory locations. The other three are chosen from peaks between these. Following this compression function, the vocal signal is represented by an amplitude and frequency representative value from each of six peaks, plus a total energy amplitude from the total signal unfiltered for, say, ten times per second, for a ten second sample. This provides a total of 1300 values.

The algorithms allow for variations in sample length in case the operator overrides the sample length switch with the override off-switch to prevent continuation during an unexpected noise interruption. The algorithms do this by using averages not significantly sensitive to changes in sample number beyond four or five seconds of sound signal. The reason for a larger speech sample, if possible, is to capture the speaker's average "style" of speech, typically evident within 10 to 15 seconds.

The output of this compression function is fed to the element assembly and storage algorithm which assemblies (a) four voice quality values to be described below; (b) a sound "pause" or on-to-off ratio; (c) "variability'-'—the difference between each peak's amplitude for the present sweep and that of the last sweep; differences between each peak's frequency number for the present sweep and that of the last sweep; and difference between the total unfiltered energy of the present sweep and that of the last sweep; (d) a "syllable change approximation" by obtaining the ratio of times that the second peak changes greater than 0.4 between sweeps to the total number of sweeps with sound; and (e) "high frequency analysis"—the ratio of the number of sound-on sweeps that contain a non-zero value in this peak for the number six peak amplitude. This is a total of 20 elements available per sweep. These are then passed to the dimension assembly algorithm.

The four voice quality values used as elements are (1) The "spread"—the sample mean of all the sweeps' differences between their average of the frequency representative values above the maximum amplitude peak and the average of those below, (2) The "balance"—the sample means of all the sweeps' average amplitude values of peaks 4, 5 & 6 divided by the average of peaks 1 & 2. (3) "envelope flatness high"—the sample mean of all the sweeps' averages of their amplitudes above the largest peak divided by the largest peak, (4) "envelope flatness low"—the sample mean of all the sweeps' averages of their amplitudes below the largest peak divided by the largest peak.

The voice-style dimensions are labeled "resonance" and "quality", and are assembled by an algorithm involving a coefficient matrix operating on selected elements. Table 1 details the equation relating the elements and coefficients to the voice dimensions.

The "speech-style" dimensions are labeled "variability-monotone", "choppy-smooth", "stacatto-sustain", "attack-soft", "affectivity-control". These five dimensions, with names pertaining to each end of each dimension, are measured and assembled by an algorithm involving a coefficient matrix operating on 15 of the 20 sound elements, detailed in Table 2 and the specification section.

The perceptual-style dimensions are labeled "eco-structure", "invariant sensitivity", "other-self", "sensory-internal", "hate-love", "independence-dependency" and "emotional-physical". These seven perceptual dimensions with names relating to the end areas of the dimensions, are measured and assembled by an algorithm involving a coefficient matrix and operating on selected sound elemens of voice and speech (detailed in Table 3) and the specification section.

A commercially available, typical computer keyboard or keypad allows the user of the present disclosure to alter any and all coefficients for redefinition of any assembled speech, voice or perceptual dimension for research purposes. Selection switches allow any or all element or dimension values to be displayed for a given subject's vocal sample. The digital processor, which utilizes an eight-bit microcomputer of the 6502 microprocessor, controls the analog-to-digital conversion of the sound signal and also controls the reassembly of the vocal sound elements into numerical values of the voice and speech, perceptual dimensions.

The microcomputer also coordinates the keypad inputs of the operator and the selected output display of values, and coefficient matrix choice to interact with the algorithms assembling the voice, speech and perceptual dimensions. The output selection switch simply directs the output to any or all output jacks suitable for feeding the signal to typical commercially available monitors, modems, printers or by default to a light-emitting, on-board readout array.

By evolving group profile standards using this invention, a researcher can list findings in publications by occupations, dysfunctions, tasks, hobby interests, cultures, languages, sex, age, animal species, etc. Or, the user may compare his/her values to those published by others or to those built into the machine.

It is an object of the present invention to provide a method and apparatus for segmenting vocal sounds of organisms, particularly humans, to determine vocal style elements, and make them available to a user in near real time.

It is another object of the present invention to provide a method and apparatus for analyzing the vocal sounds of organisms, particularly humans to determine the proximity of vocal style elements and dimensions to machine supplied standard sets, or user supplied sets, to provide the user the means to assess the probability of vocal style group membership or vocal profile of the subject.

It is still another object of the present invention to provide a method and apparatus for analyzing the vocal sounds of humans to determine the proximity of vocal style elements and dimensions to machine supplied standard or user supplied sets, related to perceptual dimensions, associated with specified environmental stimuli, including, but not limited to, long term stimuli associated with occupations, situations, or cultures.

It is still a further object of the present invention to provide a method and apparatus for analyzing the vocal sounds of organisms, particularly humans, to determine the relationship of variability of vocal style elements and dimensions to specific environmental stimuli including user internally generated stimuli in a biofeedback mode.

It is still another object of the present invention to provide a method and apparatus for analyzing the vocal sounds of groups of humans, either additively from one at a time measurement with accumulated results, or taken simultaneously as a sound environment from a group such as a classroom, therapy session, occupational environment, or movie theater, such that group dynamics, in perceptual terms, can be monitored under different stimuli, such as before and after watching a movie, or a scene, or before and after changing classroom teachers, etc., to assist the assessment of group effect.

It is a further object of the present invention to provide a small, inexpensive, vocal sound analyzer that can analyze the vocal and perceptual style of individuals or groups, with or without a coin operated enabling switch, and with and without the subject being aware of the measurement, in a desk top or brief case size container, with visual display output of measurements for both measurement and research purposes, and with read only memory coefficients, with key and switch controls for user supply of coefficients to alter style interrelationships.

BRIEF DESCRIPTION OF THE DRAWINGS

Other objects, features and advantages of the invention will be apparent from a study of the written description and the drawings, in which.

DETAILED DESCRIPTION OF THE PREFERRED EMBODIMENT

Figure 1:
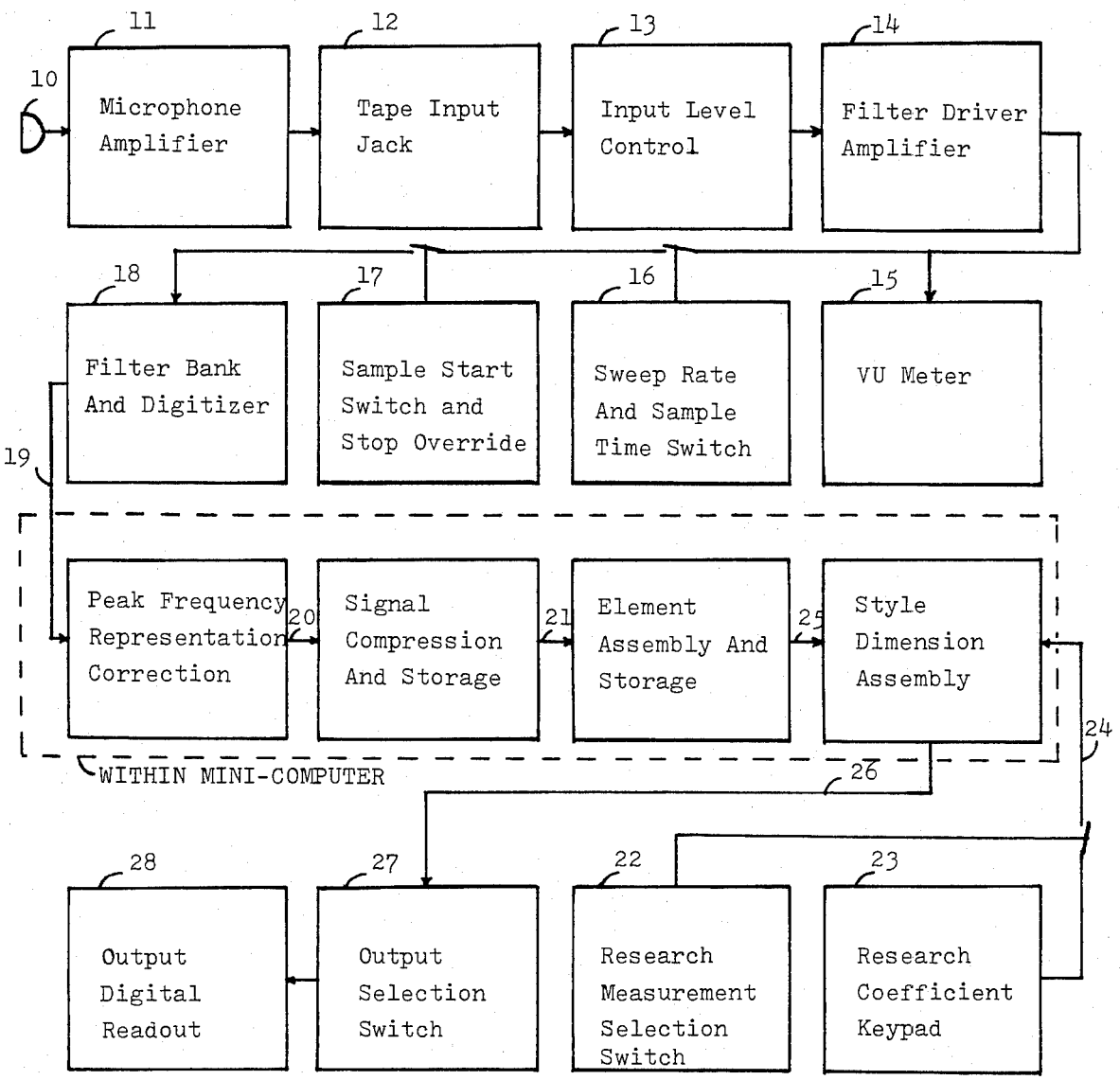
FIG. 1 is a schematic diagram in block form of an apparatus in accordance with the invention.

Referring now to FIG. 1 of the drawings, a vocal utterance is introduced into the vocal sound analyzer through a microphone 10, and through a microphone amplifier 11 for signal amplification, or from taped input through tape input jack 12 for use of a pre-recorded vocal utterance input. An input level control 13 adjusts the vocal signal level to the filter driver amplifier 14. The filter driver amplifier 14 amplifies the signal and applies the signal to V.U. meter 15 for measuring the correct operating signal level.

The sweep rate per second and the number of sweeps per sample is controlled by the operator with the sweep rate and sample time switch 16. The operator starts sampling with the sample start switch and stop override 17. The override feature allows the operator to manually override the set sampling time, and stop sampling, to prevent contaminating a sample with unexpected sound inteference, including simultaneous speakers. This switch also, connects and disconnects the microprocessor's power supply to standard 110 volt electrical input prongs.

The output of the filter driver amplifier 14 is also applied to a commercially available microprocessor-controlled filter bank and digitizer 18, which segments the electrical signal into $\frac{1}{3}$ octave regions over the audio frequency range for the organism being sampled and digitizes the voltage output of each filter. The inventor utilized, in a specific working embodiment of the invention, 25 $\frac{1}{3}$ octave filters of an Eventide spectrum analyzer with filter center frequencies ranging from 63 HZ to 16,000 HZ. Also utilized was an AKAI microphone and tape recorder with built in amplifier as the input into the filter bank and digitizer 18. The number of sweeps per second that the filter bank utilizes is approximately ten sweeps per second. Other microprocessor-controlled filter banks and digitizers may operate at different speeds.

Any one of several commercially available microprocessors is suitable to control the aforementioned filter bank and digitizer. The preferred embodiment used a common 6502 based mini-computer.

As with any complex sound, amplitude across the audio frequency range for a "time slice" 0.1 of a second will not be constant or flat, rather there will be peaks and valleys. The frequency representative values of the peaks of this signal, 19, are made more accurate by noting the amplitude values on each side of the peaks and adjusting the peak values toward the adjacent filter value having the greater amplitude. This is done because, as is characteristic of adjacent ⅓ octave filters, energy at a given frequency spills over into adjacent filters to some extent, depending on the cut-off qualities of the filters. In order to minimize this effect, the frequency of a peak filter is assumed to be the center frequency only if the two adjacent filters have amplitudes within 10% of their average. To guarantee discreet, equally spaced, small values for linearizing and normalizing the values representing the unequal frequency intervals, each of the 25 filters are given number values 1 through 25 and these numbers are used throughout the remainder of the processing. This way the 3,500 HZ difference between filters 24 and 25 becomes a value of 1, which in turn is also equal to the 17 HZ difference between the first and second filter.

To prevent more than five sub-divisions of each filter number and to continue to maintain equal valued steps between each sub-division of the 1 to 25 filter numbers, they are divided into 0.2 steps and are further assigned as follows. If the amplitude difference of the two adjacent filters to a peak filter is greater than 30% of their average, then the peak filter's number is assumed to be nearer to the half-way point to the next filter number than it is of the peak filter. This would cause the filter number of a peak filter, say filter number 6.0, to be increased to 6.4 or decreased to 5.6, if the bigger adjacent filter represents a higher, or lower frequency, respectively. All other filter values, of peak filters, are automatically given the value of its filter number +0.2 and −0.2 if the greater of the adjacent filter amplitudes represents a higher or lower frequency respectively.

The segmented and digitally represented vocal utterance signal 19, after the aforementioned frequency correction 20, is compressed to save memory storage by disgarding all but six amplitude peaks. The inventor found that six peaks were sufficient to capture the style characteristics, so long as the following characteristis are observed. At least one peak is near the fundamental frequency; exactly one peak is allowed between the region of the fundamental frequency and the peak amplitude frequency, where the nearest one to the maximum peak is preserved; and the first two peaks above the maximum peak is saved plus the peak nearest the 16,000 HZ end or the 25th filter if above 8k hz, for a total of six peaks saved and stored in microprocesser memory. This will guarantee that the maximum peak always is the third peak stored in memory and that the sixth peak stored can be used for high frequency analysis, and that the first one is the lowest and nearest to the fundamental. This compression to specific peaks is diagrammed on FIG. 5.

Following the compression of the signal to include one full band amplitude value, the filter number and amplitude value of six peaks, and each of these thirteen values for 10 samples for a 10 second sample, (1300 values), 21 of FIG. 1, sound element assembly begins.

To arrive at voice style "quality" elements, this invention utilizes relationships between the lower set and higher set of frequencies in the vocal utterance. The speech style elements, on the other hand, is determined by a combination of measurements relating to the pattern of vocal energy occurrences such as pauses and decay rates. The voice style elements are listed in the first column on Table 1. These voice style "quality" elements emerge from spectrum analysis FIG. 2, 30, 31, and 32. The speech style elements emerge from the other four analysis functions as shown in FIG. 2, 33, 34, 35, and 36 and Table 2.

The voice style quality analysis elements stored are named and derived as: (1) the spectrum "spread"—the sample mean of the distance in filter numbers between the average of the peak filter numbers above, and the average of the peak filter numbers below the maximum peak, for each sweep, FIG. 2, 30; (2) the spectrum's energy "balance"—the mean for a samlple of all the sweep's ratios of the sum of the amplitudes of those peaks above to the sum of the amplitudes below the maximum peak, 31; (3) the spectrum envelope "flatness"—the arithmetic means for each of two sets of ratios for each sample—the ratios of the average amplitude of those peaks above (high) to the maximum peak, and of those below (low) the maximum peak to the maximum peak, for each sweep, 32.

The speech style elements, that are stored, are named and derived respectively: (1) spectrum variability—the six means, of an utterance sample, of the numerical differences between each peak's filter number, on one sweep, to each corresponding peak's filter number on the next sweep, and also the six amplitude value differences for these six peaks and also including the full spectrum amplitude differences for each sweep, producing a sample total of 13 means, 33; (2) utterance pause ratio analysis—the ratio of the number of sweeps in the sample that the full energy amplitude values were pauses (below two units of amplitude value) to the number that had sound energy (greater than one unit of value), 34; (3) syllable change approximation—the ratio of the number of sweeps that the third peak changed number value greater than 0.4 to the number of sweeps having sound during the sample, 35; (4) and, high frequency analysis—the ratio of the number of sweeps for the sample that the sixth peak had an amplitude value to the total number of sweeps, 36.

Sound styles are divided into the seven dimensions in the method and apparatus of this invention, depicted in Tables 1 and 2. These were determined to be the most sensitive to an associated set of seven perceptual or cognition style dimensions listed in Table 3.

Figure 2:
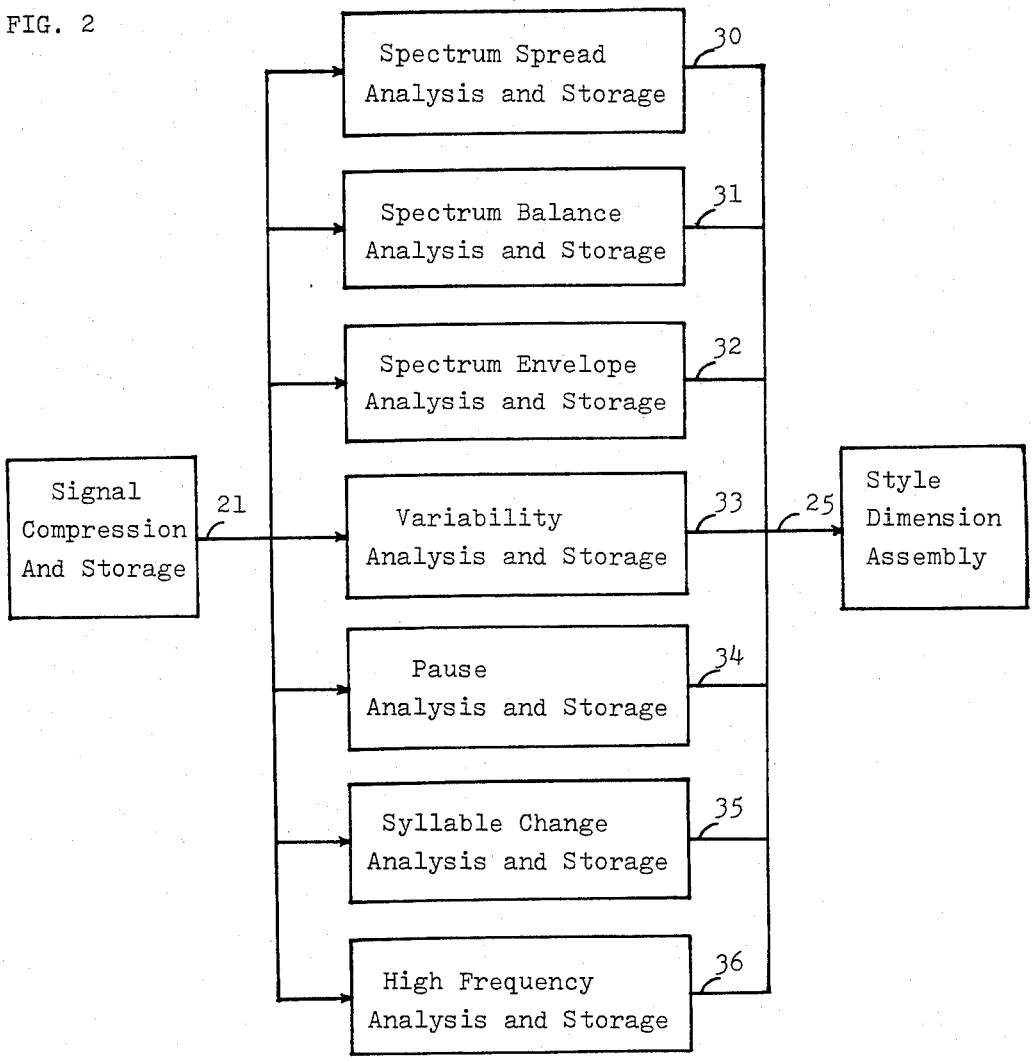
FIG. 2 is a schematic diagram in block form of the element assembly and storage block in FIG. 1.

The procedure for relating the sound style elements to voice, speech, and perceptual dimensions for output, FIG. 1, 28, is through equations that determine each dimension as a function of selected sound style elements, FIG. 2, 30, through 36. Table 1 contains both the equation and the permanantly stored coefficient array, CVij, in a read only memory (ROM) digital circutry, which relates the voice style dimensions to the voice style elements, FIG. 2, 30, 31, and, 32. Note that many of the CVij's in Table 1 are zeros indicating that these have no effect on the associated voice style dimension. The reason for the arrays, including zeros, is to provide the operator memory locations for entering through switches or Keys, FIG. 1, 22 and 23, alternate coefficients for research purposes. Table 2 similarly relates the speech style elements, 33 through 36 of FIG. 2, to the speech style dimensions.

Table 3, depicts the relationship between seven perceptual style dimensions, (Jones, J. M., book in press, 1982) and the sound style elements, 30 through 36. Again, the purpose of having an optional input coefficient array containing zeros is to allow the apparatus operator to switch or key in changes in these coefficients for research purposes, 22, 23. The astute operator can develop different perceptual dimensions or even personality or cognitive dimensions, or factors, (if he prefers this terminology) which require different coefficients altogether. This is done by keying in the desired set of coefficients and noting which dimension (26) that he is relating these to. For instance, the other-self dimension of Table 3 may not be a wanted dimension by a researcher who would like to replace it with a user perceptual dimension that he names introvert-extrovert. By replacing the coefficient set for the other-self set, by trial sets, until an acceptably high correlation exists between the elected combination of weighted sound style elements and his externally determined introvert-extrovert dimension, the researcher can thusly use that slot for the new introvert-extrovert dimension, effectively renaming it. This can be done to the extent that the set of sound elements of this invention are sensitive to a user dimension of introvert-extrovert, and the researcher's coefficient set reflects the appropriate relationship. This will be possible with a great many user determined dimensions to a useful degree, thereby enabling this invention to function productively in a research environment where new perceptual dimensions, related to sound style elements, are being explored, developed, or validated.

TABLE 2

| Elements (Differences) ESi(2) | Speech Style Dimensions' (DSj)(1) Coefficients CSi1 | CSi2 | CSi3 | CSi4 | CSi5 |
|---|---|---|---|---|---|
| No.-1 | 0 | 0 | 0 | 0 | 0 |
| Amp-1 | 0 | 0 | 0 | 0 | 0 |
| No.-2 | 1 | 0 | 0 | 0 | 1 |
| Amp-2 | 1 | 0 | 0 | 1 | 0 |
| No.-3 | 0 | 0 | 0 | 0 | 0 |
| Amp-3 | 0 | 0 | 0 | 0 | 0 |
| No.-4 | 0 | 0 | 0 | 0 | 0 |
| Amp-4 | 0 | 0 | 0 | 0 | 0 |
| No.-5 | 0 | 0 | 0 | 0 | 1 |
| Amp-5 | 0 | 0 | 1 | 0 | 0 |
| No.-6 | 0 | 0 | 0 | 0 | 0 |
| Amp-6 | 0 | 0 | 0 | 0 | 0 |
| Amp-7 | 0 | 1 | 1 | 0 | −1 |
| Pause | 0 | 1 | 1 | 0 | 0 |
| Peak 6 | 0 | 0 | −1 | −1 | 1 |

(1) $DSj = \sum_{i=1}^{15} CSij \cdot ESi$, where j = 1,5

DS1 = Variability-Monotone
DS2 = Choppy-Smooth
DS3 = Staccato-Sustain
DS4 = Attack-Soft
DS5 = Affectivity-Control.
(2) No.-1 through 6 = Peak Filter Differences 1-6, and Amp-1 through 6 = Peak Amplitude Differences 1-6.
Amp-7 = Full Band Pass amplitude Differences.

TABLE 3

| Elements Differences EPi | Perceptual Style Dimension's (DPj)(1) Coefficients CPi1 | CPi2 | CPi3 | CPi4 | CPi5 | CPi6 | CPi7 |
|---|---|---|---|---|---|---|---|
| Spread | 0 | 0 | 0 | 0 | 0 | 0 | 0 |
| Balance | 1 | 1 | 0 | 0 | 0 | 0 | 0 |
| Env-H | 0 | 1 | 0 | 0 | 0 | 0 | 0 |
| Env-L | 1 | 0 | 0 | 0 | 0 | 0 | 0 |
| No.-1 | 0 | 0 | 0 | 0 | 0 | 0 | 0 |
| Amp-1 | 0 | 0 | 0 | 0 | 0 | 0 | 0 |
| No.-2 | 0 | 0 | 1 | 0 | 0 | 0 | 1 |
| Amp-2 | 0 | 0 | 1 | 0 | 0 | 1 | 0 |
| No.-3 | 0 | 0 | 0 | 0 | 0 | 0 | 0 |
| Amp-3 | 0 | 0 | 0 | 0 | 0 | 0 | 0 |
| No.-4 | 0 | 0 | 0 | 0 | 0 | 0 | 0 |
| Amp-4 | 0 | 0 | 0 | 0 | 0 | 0 | 0 |
| No.-5 | 0 | 0 | 0 | 0 | 0 | 0 | 1 |
| Amp-5 | 0 | 0 | 0 | 0 | −1 | 0 | 0 |
| No.-6 | 0 | 0 | 0 | 0 | 0 | 0 | 0 |
| Amp-6 | 0 | 0 | 0 | 0 | 0 | 0 | 0 |
| Amp-7 | 0 | 0 | 0 | 1 | 1 | 0 | −1 |
| Pause | 0 | 0 | 0 | 1 | 1 | 0 | 0 |
| Peak 6 | 0 | 0 | 0 | 0 | −1 | −1 | 1 |

(1)$DPj = \sum_{i=1}^{19} CPij \cdot EPi$, where j = 1,7;

DP1 = Eco-Structure High-Low;
DP2 = Invarient Sensitivity High-Low;
DP3 = Other-Self;
DP4 = Sensory-Internal;
DP5 = Hate-Love;
DP6 Dependency-Independency;
DP7 = Emotional-Physical.
(2)No.-1 through 6 = Peak Filter Differences 1-6; Amp-1 Through 6 = Peak amplitude Differences 1-6; and Amp-7 Full band pass amplitude differences.

The primary results available to the user of this invention is the dimension values, 26, available selectively by a switch, 27, to be displayed on a standard light display, and also selectively for monitor, printer, modem, or other standard output devices, 28. These can be used to determine how close the subject's voice is on any or all of the sound or perceptual dimensions from the built-in or published or personally developed controls or standards.

What is claimed is:

1. A vocal sound analysis method and apparatus for producing a display of vocal sound derived values of a subject, which display can be observed for indications of the subject's vocal/perceptual profile, the apparatus comprising the combination of:

input means including a microphone and amplifier for receiving vocal sounds and generating representative voltage signals;

segmentation means coupled to said input means to receive said representative voltage signals and segment said signal multiple sweeps each of several consecutive seconds into $\frac{1}{3}$ octave regions covering the audio frequency range, and one whole audio band pass region, further comprising digitizer means to digitize said segmented signals;

computer means coupled to said digitizer means containing a permanently stored instruction equation and logic algorithm and memory means to change said digitized signals into frequency and amplitude value representations and to manipulate and store said signals;

said algorithm means further comprising compression means coupled to said memory containing said digital value representations, that reduce the quantity of said values by first discarding all said values but the frequency and amplitude representative values of the amplitude peaks, and then discarding all but six said peak amplitudes' said representative values, and further saving one unfiltered or full band width amplitude representative value from each sweep;

said algorithm means further comprising correction means, coupled to said memory containing said peak's frequency and amplitude values, that further causes each peak's frequency representative value to be adjusted toward the frequency representative value of the adjacent filter having the larger amlplitude, and further, normalizing said frequency representative values by causing all frequency representative values to be multibles of a single small decimal value;

said algorithm means further comprising assembly means connected to the said correction means for assembling the said stored peaks' amplitude and frequency representative values and said full unfiltered signal amplitude representative value into vocal sound style elements, and storing said elements in said memory means;

said algorithm means further comprising coefficient matrix and instruction means coupled to said assembly means that calculates a summation of the products of selected said coefficients and said vocal sound style elements, to produce vocal/perceptual style dimension values that define said vocal/perceptual profile;

display means coupled to the said memory means for displaying all said values on a visually observable medium;

selection means comprising a switch connected to said input means to select a point in time for beginning and terminating said input sampling, said switch including means to connect and disconnect said apparatus to an electrical power source;

said selection means further comprising switch means to select the number of said sweeps per second coupled to the said segmentation means;

keypad means coupled to said coefficient matrix means for the user to select to override the use of said permanently stored coefficient matrix and to accept a user provided coefficient matrix;

and keypad further comprising selection means connected to the said display means for user selection of said display means.

2. The method and apparatus as recited in claim 1 in which said vocal style element assembly includes voice spectrum spread, balance and envelope analysis.

3. The method and apparatus as recited in claim 1 in which said vocal style element assembly further includes speech style elements variability, pause analysis, syllable change approximation, and high frequency analysis.

4. The method and apparatus as recited in claim 2 in which said spectrum spread analysis element assembly means comprises said algorithm means for obtaining the average of said filter numbers for both above and below said peak exhibiting the maximum amplitude and then the said algorithm means for obtaining the difference between these two averages for each said sweep for a said sample and obtaining and storing one said sample mean of said differences—labeled "spectrum spread".

5. The method and apparatus as recited in claim 2 in which said spectrum balance analysis element assembly means comprises said algorithm means for obtaining the ratio of the sum of said amplitudes of said peaks above the peak exhibiting the maximum amplitude to the sum of said ampltudes below the said maximum peak for each said sweep of a said sample and for obtaining and storing the one mean of the said ratios-labeled "spectrum balance ratio".

6. The method and apparatus as recited in claim 2 in which said spectrum envelope analysis element assembly means comprises said algorithm means for obtaining the ratios of the average of said amplitudes of said peaks above (high) and also below (low) the said maximum peak to said maximum peak for each said sweep of the said sample, and for obtaining and storing the two sample means of the two sets of ratios from the said sweeps—labeled "envelope flatness ratios."

7. The method and apparatus as recited in claim 3 wherein said variability element assembly means comprises said algorithm means for obtaining the sample averages of the numerical difference between sequential sweep amplitudes that are non-zero, and also between sequential sweep filter numbers of corresponding peaks, of the six said peaks, and also between sequential sweep non-zero amplitude values of the full band for each sweep, and obtaining and storing in said memory means the thirteen said averages of said differences for the said sample-labeled collectively "spectrum variability."

8. The method and apparatus as recited in claim 3 wherein said pause analysis element assembly means comprises said algorithm means for obtaining the ratio of the number of said sweeps which exhibit no said sound amplitude to the number of said sweeps, and further said algorithm means for obtaining and storing the mean of said ratios—labeled "pause ratio."

9. The method and apparatus as recited in claim 3 wherein said syllable change approximation element assembly means comprises said algorithm means for obtaining the ratio of the number of said sweeps that the third peak changed said number value from its previous sweep value an amount greater than 0.4, to the number of said sweeps and determination means to obtain and store the mean of said ratios-labeled "syllable change aproximation ratio".

10. The method and apparatus as recited in claim 3 in which said high frequency analysis element assembly means comprises said algorithm means for obtaining and storing the ratio of the number of said sweeps for the said sample that the said sixth peak had a said amplitude value, to the number of said sweeps in the sample—labeled "high frequency ratio."

11. The method and apparatus as recited in claim 1 wherein said vocal/perceptual profile includes a voice style dimension defined by said sound style elements, said permanent coefficient means, said instruction equation algorithm means labeled as resonant-flat.

12. The method and apparatus as recited in claim 1 wherein said vocal/perceptual profile further includes a voice style dimension defined by said sound style elements, said permanent coefficient means, said instruction equation algorithm means labeled as quality high-low.

13. The method and apparatus as recited in claim 1 wherein said vocal/perceptual profile further includes a speech style dimension defined by said vocal sound style elements, said permanent coefficient means, said instruction equation means, labeled veriability-monotone.

14. The method and apparatus as recited in claim 1 wherein said vocal/perceptual profile further includes a speech style dimension defined by said vocal sound style elements, said permanent coefficient means, said instruction equation means, labeled choppy-smooth.

15. The method and apparatus as recited in claim 1 wherein said vocal/perceptual profile further includes a speech style dimension defined by said vocal sound style elements, said permanent coefficient means, said instruction equation means, labeled staccato-sustain.

16. The method and apparatus as recited in claim 1 wherein said vocal/perceptual profile further ncludes a speech style dimension defined by said vocal sound style elements, said permanent coefficient means, said instruction equation means, labeled attack-soft.

17. The method and apparatus as recited in claim 1 wherein said vocal/perceptual profile further includes a speech style dimension defined by said vocal sound style elements, said permanent coefficient means, said instruction equation means, labeled affectivity-control.

18. The method and apparatus as recited in claim 1 wherein said vocal/perceptual profile further includes a perceptual style dimension defined by said vocal sound style elements, said permanent coefficient means, said instruction equation means labeled as "eco-structure high-low".

19. The method and apparatus as recited in claim 1 wherein said vocal/perceptual profile further includes a perceptual style dimension defined by said vocal sound style elements, said permanent coefficient means, said instruction equation means labeled as "invariant sensitivity high-low".

20. The method and apparatus as recited in claim 1 wherein said vocal/perceptual profile further includes a perceptual style dimension defined by said vocal sound style elements, said permanent coefficient means, said instruction equation means, labeled "other-self".

21. The method and apparatus as recited in claim 1 wherein said vocal/perceptual profile further includes a perceptual style dimension defined by said vocal sound style elements, said permanent coefficient means, said instruction equation means, labeled "sensory-internal".

22. The method and apparatus as recited in claim 1 wherein said vocal/perceptual profile further includes a perceptual style dimension defined by said vocal sound style elements, said permanent coefficient means, said instruction equation means, labeled "hate-love".

23. The method and apparatus as recited in claim 1 wherein said vocal/perceptual profile further includes a perceptual style dimension defined by said vocal sound style elements, said permanent coefficient means, said instruction equation means, labeled "independency-dependency".

24. The method and apparatus as recited in claim 1 wherein said vocal/perceptual profile further includes a perceptual style dimension defined by said vocal sound style elements, said permanaent coefficient means, said instruction equation means, labeled "emotional-physical".

* * * * *